US006638101B1

(12) United States Patent
Botelho

(10) Patent No.: US 6,638,101 B1
(45) Date of Patent: Oct. 28, 2003

(54) QUICK GRIP CABLES

(76) Inventor: Albert P. Botelho, 74 A Yore Road, Toronto, Ontario B8 (CA), M6M 1W7

( * ) Notice: Subject to any disclaimer, the term of this patent is extended or adjusted under 35 U.S.C. 154(b) by 0 days.

(21) Appl. No.: 10/156,048

(22) Filed: May 28, 2002

(51) Int. Cl.[7] ..... H01R 11/00
(52) U.S. Cl. ..... 439/504; 439/490; 439/188; 439/829
(58) Field of Search ..... 439/504, 490, 439/489, 829, 188

(56) References Cited

U.S. PATENT DOCUMENTS 4,897,044 A * 1/1990 Rood ..... 439/504
4,934,957 A * 6/1990 Bellusci ..... 439/504
4,938,712 A * 7/1990 Black ..... 439/504
5,066,905 A * 11/1991 Betton et al. ..... 439/504
5,601,452 A * 2/1997 Ruffa ..... 439/504
6,254,426 B1 * 7/2001 Iacovelli et al. ..... 439/504
6,386,907 B1 * 5/2002 Ruffa ..... 439/504

* cited by examiner

*Primary Examiner*—Gary Paumen

(57) ABSTRACT

A jumper cable assembly is disclosed comprising two insulated electrical cables and terminal clamps at both ends of the cables. Each terminal clamp comprise a handle section, a jaw section, a pivot section joining the handle section with the jaw section, a means of locking and releasing the jaws section closed, and a lighting element which automatically turns on when the jaw section is opened. This jumper cable assembly is able to securely lock onto a battery terminal or chassis and provides illumination for attaching the jumper cables.

20 Claims, 6 Drawing Sheets

QUICK GRIP CABLES

BACKGROUND OF THE INVENTION

1. Field of the Invention

The present invention relates to a jumper cable assembly for use in charging automotive, marine or other batteries. The jumper cable assembly has particular utility in that it provides a secure locking clamp and has automatic illumination.

2. Description of the Art

When a car battery or other 12-volt battery dies, the vehicle owner connects the dead battery with a charged battery in order to jump-start the vehicle. The batteries are connected via two cables normally having a spring loaded clamp on both terminal ends. The clamps usually have serrated teeth for gripping onto the round battery terminal and at least one portion of the jaws is electrically connected to a conductive cable.

However, the cables known in the art have a number of problems. The spring clamp is often difficult to open, and sometimes requires substantial hand strength to open wide enough to maneuver around and lock onto a battery terminal. When attached, the clamp often lacks a secure connection. It is common for the clamp to slip off the terminal. This can be exasperated by the vibrations of the engine connected to the live battery. Further problems arise when the battery must be charged using jumper cables in the dark. Even if a flashlight is available, it is inconvenient to use unless there is an extra person to hold it. With no source of illumination on either battery, it can be difficult for someone not extremely familiar with both engines to determine where the positive and negative terminals of the battery are.

When a clamp is initially connected with the terminal or regains contact with the terminal after being momentarily disconnected, there can be a surge of current from the charging battery to the discharged battery, which creates a spark. This spark may ignite hydrogen or other explosive gases that are produced by the battery and can be very dangerous. For example, the gas could explode in a person's face while trying to secure or re-secure the clamp, which slipped off the terminal.

Also, when the connection between the clam and the battery terminal is not secure, the current loop charging the battery is destroyed, making the time required to re-charge the previously discharged battery greater.

It therefore would be advantageous to have a jumper cable assembly that is convenient, safe, provide for a secure, lockable grip, and have the ability to light the work area.

The use of jumper cables is known in the art. For example, U.S. Pat. No. 167,529 to Verge discloses a jumper cable assembly that provides cooperating and releasable lockable cable clamps and terminals. This invention provides clamps, which can be locked onto the terminal. However, the Verge patent does not address the problem of easy clamping and release on a variety of terminal shapes and types, and has further drawbacks of not providing illumination or allow for simple, one handed, operation.

Similarly, U.S. Pat. No. 4,934,957 to Bellusci discloses jumper cables designed to eliminate any electrical spark when cable clamps are connected across the battery terminals. However, Bellusci's patent does not provide for jumper cable clamps that are able to lock onto the terminal for a secure connection, and does not allow for illumination of the work area.

U.S. Pat. No. 4,527,111 to Branham discloses a jumper cable with a safety feature allowing the connection of two batteries with correct polarity regardless of the polarity with which the battery jumper cables are actually connected. This invention provides for a light when the jumper cables are correctly attached to the battery but does not provide for either a secure connection with the battery terminal or a light to aid in connecting the jumper cables to the appropriate battery terminal or chassis.

U.S. Pat. No. 4,897,044 to Rood discloses a jumper cable assembly having spring loaded clamps and a test probe circuit with a diode, lamp or other attention getting means mounted on the negative terminal clamp that will light up when the proper connection has been made. A separate lamp, bell, or other device will light up or sound when the jumper cables are connected improperly. However, Rood's patent does not provide for jumper cable clamps that are able to lock onto the terminal for a secure connection, and do not allow for illumination of the work area.

Similarly, U.S. Pat. No. 4,938,712 to Black discloses a jumper cable assembly having spring-loaded clamps with an automatic light at one end that indicates the polarity of the batteries being connected. This patent has the same problems as those described hereinabove in that a secure, locking connection to the battery terminal is not provided, and there is no illumination provided by the apparatus outside of the safety feature.

Lastly, U.S. Pat. No. Des. 346,149 to Deering discloses a lighted jumper cable having a light along one side of clamp arm. This patent does not provide for jumper cable clamps that are able to securely lock onto the battery terminal and does not provide an efficient, automatic light that turns on when illumination is needed and turns off when the jumper cables have been properly connected and is no longer needed.

While the above-described devices fulfill their respective, particular objectives and requirements, the aforementioned patents do not describe a jumper cable assembly that allows providing a secure locking clamp with automatic illumination. None of the patents described hereinabove make provisions for a jumper cable assembly with both illumination and a means to securely clamp the jumper cable assembly onto the battery terminal or chassis. The patents to Rood, Black and Deering makes no provision for a light that turns on for illuminating the work area before a proper connection is made but only provide light for the user after the connection has been made so that the user can determine if the jumper cables were connected correctly.

Therefore, a need exists for a new and improved jumper cable assembly that can be used for providing a secure clamp with automatic illumination. In this regard, the present invention substantially fulfills this need. In this respect, the jumper cable assembly according to the present invention substantially departs from the conventional concepts and designs of the prior art, and in doing so provides an apparatus primarily developed for the purpose of providing a secure clamp with automatic illumination.

SUMMARY OF THE INVENTION

In view of the foregoing disadvantages inherent in the known types of jumper cables now present in the prior art, the present invention provides an improved jumper cable assembly, and overcomes the above-mentioned disadvantages and drawbacks of the current jumper cables. As such, the general purpose of the present invention, which will be described subsequently in greater detail, is to provide a new and improved jumper cable assembly which has all the advantages of the prior art mentioned heretofore and many novel features that result in a jumper cable assembly which is not anticipated, rendered obvious, suggested, or even implied by the prior art, either alone or in any combination thereof.

To attain this, the present invention essentially comprises a positive and a negative insulated electrical cable, a pair of positive and a pair of negative terminal clamps at either end of the cables. Each terminal clamp comprise: a handle section, a jaw section, a pivot section joining the handle section with the jaw section, a means of locking and releasing the jaws section, and a lighting element in electrical communication with battery and a switch wherein current flows through the lighting element when the jaw section is open and no current flows through the lighting element when the jaw section is closed. The lighting element is preferably an ultra-bright LED. The means of locking the jaws closed may be a ratcheting system or a vise grip mechanism.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being manufactured and used in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jumper cable assembly that has all of the advantages of the art and none of the disadvantages.

It is another object of the present invention to provide a new and improved jumper cable assembly that may be easily and efficiently manufactured and marketed.

An even further object of the present invention is to provide a new and improved jumper cable assembly that has a low cost of manufacture with regard to both materials and labor, and which accordingly is then susceptible of low prices of sale to the consuming public, thereby making such jumper cable assembly economically available to the buying public.

Still another object of the present invention is to provide a new jumper cable assembly that provides in the apparatuses and methods of the art some of the advantages thereof, while simultaneously overcoming some of the disadvantages normally associated therewith.

Lastly, it is an object of the present invention to provide a new and improved method for charging automotive or other batteries using a jumper cable assembly that is easy to use, illuminates the work area when needed, and provides a secure connection between the batteries. These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
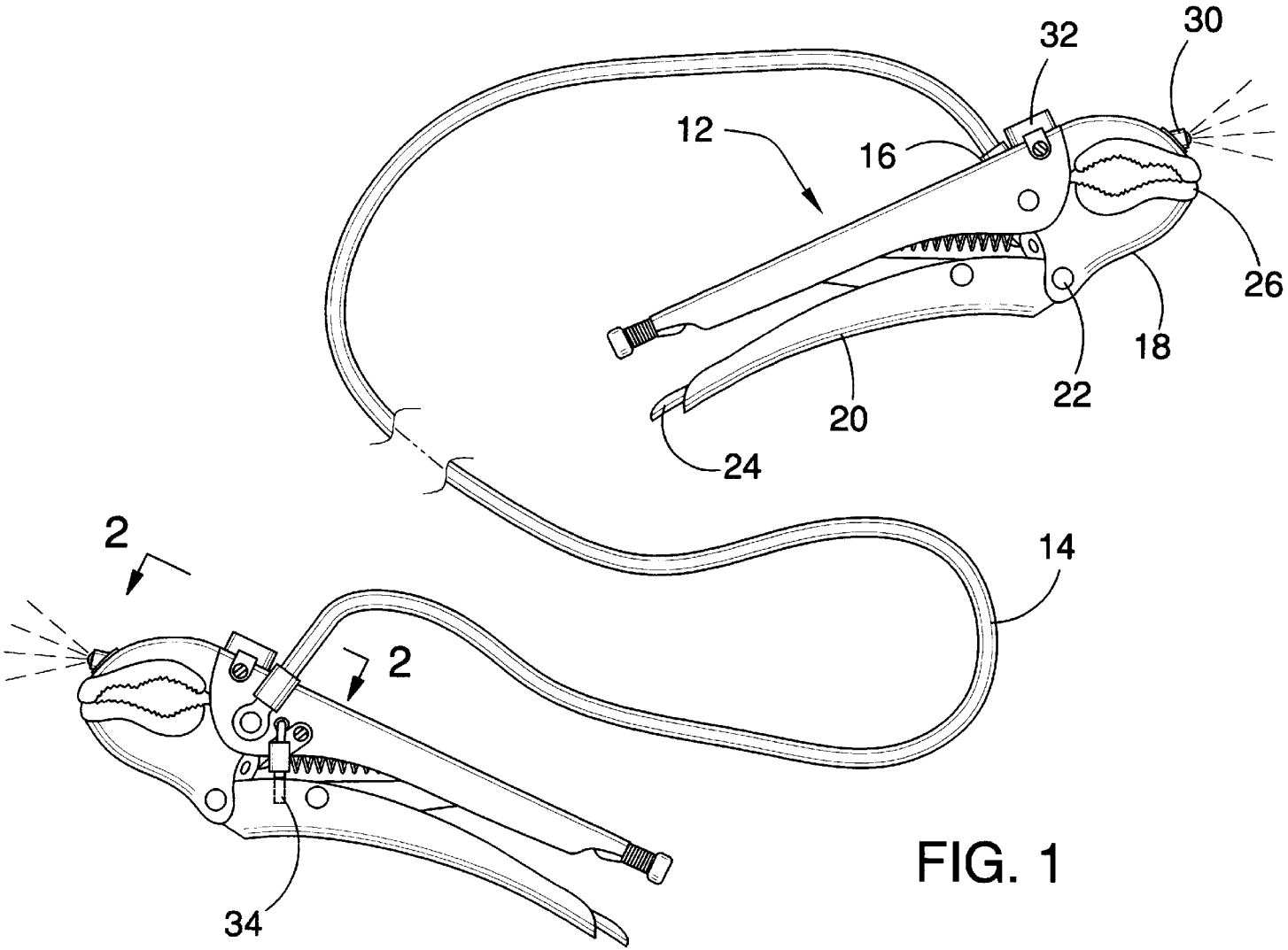
FIG. 1 is a perspective view of a preferred embodiment of the jumper cable assembly having a vise grip construction in accordance with the principles of the present invention.
Figure 2:
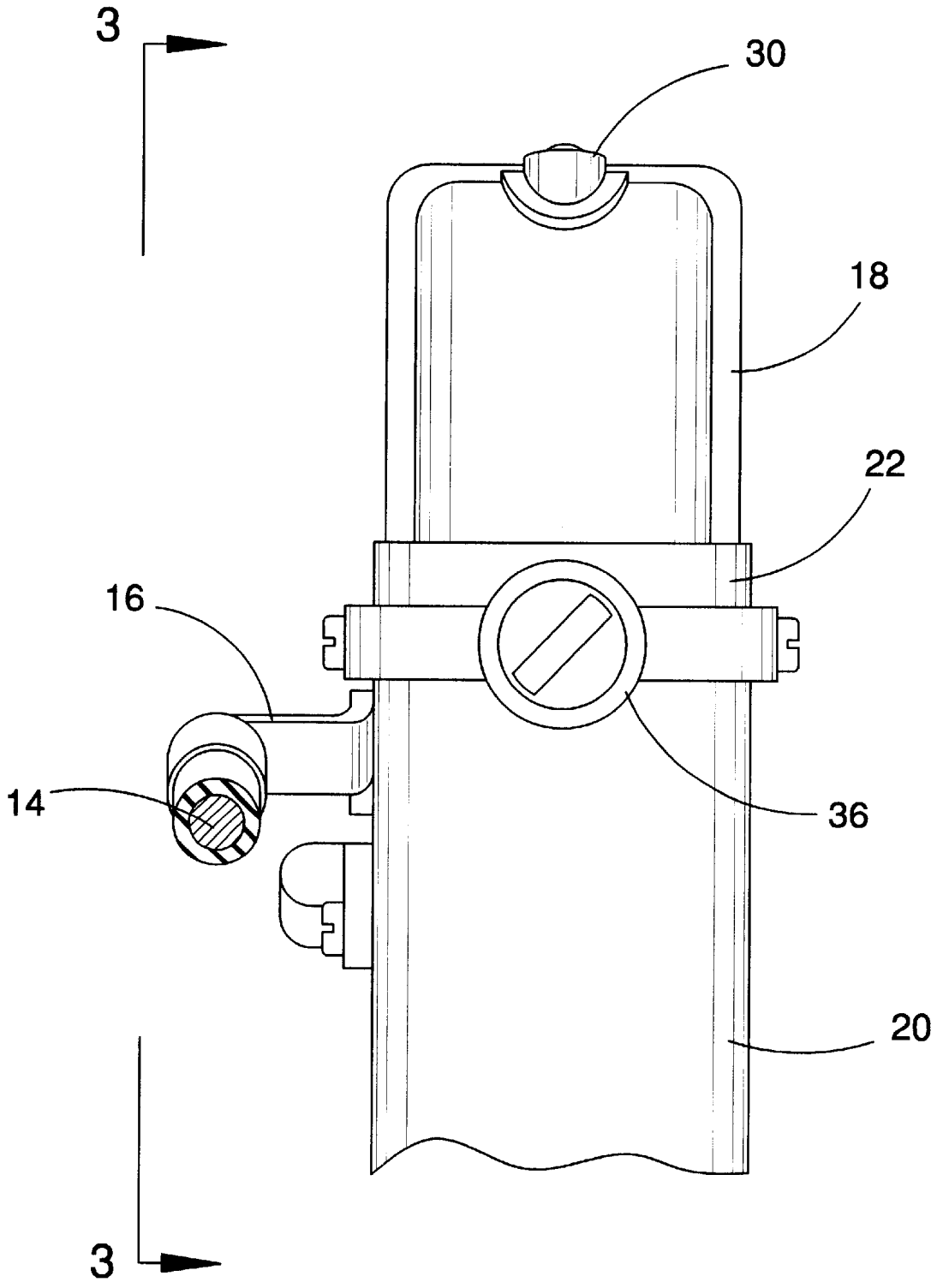
FIG. 2 is a side view of the vise grip clamp section of a jumper cable assembly of the present invention.
Figure 3:
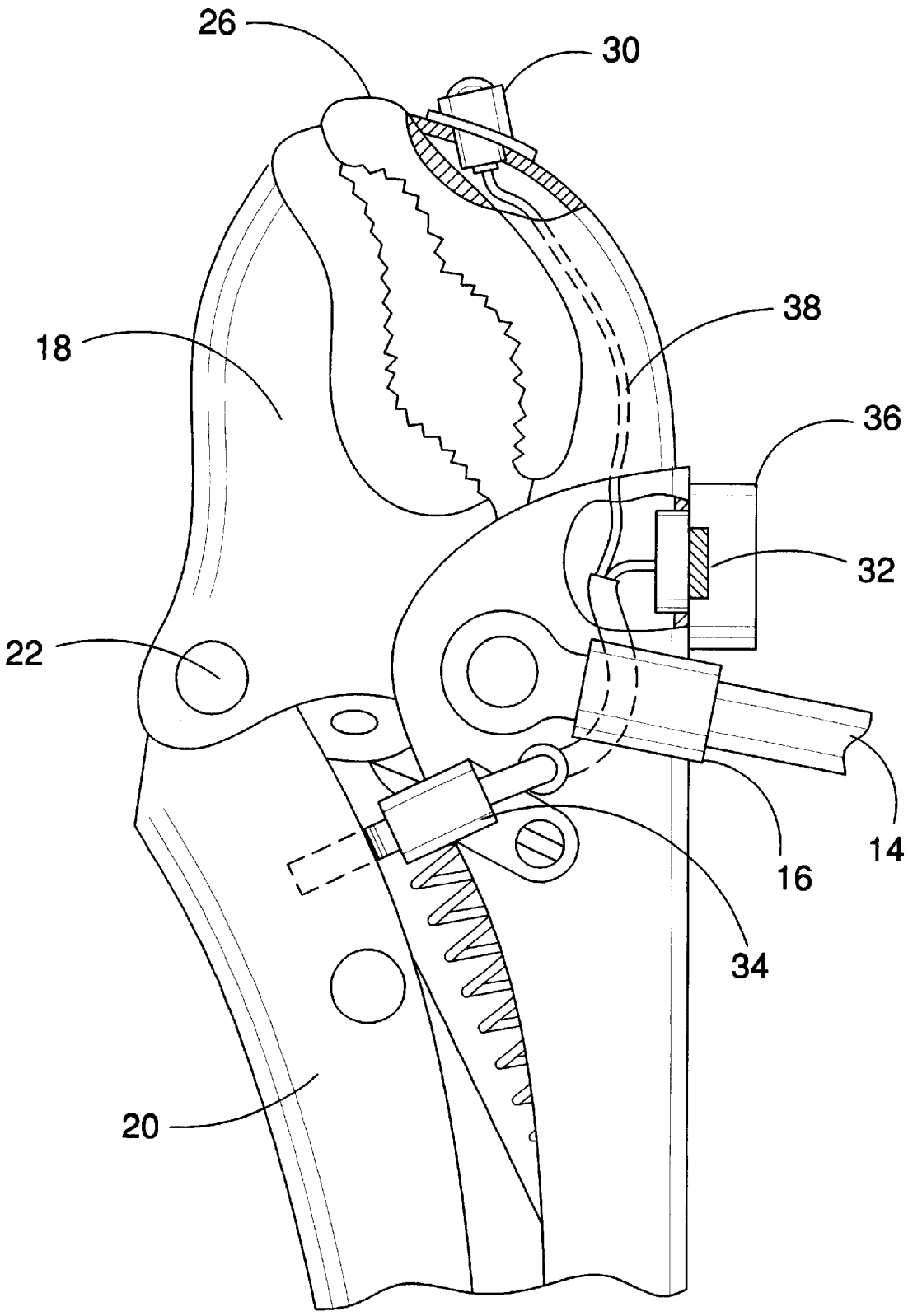
FIG. 3 is a frontal view of a vise grip clamp section of a jumper cable assembly of the present invention.
Figure 4:
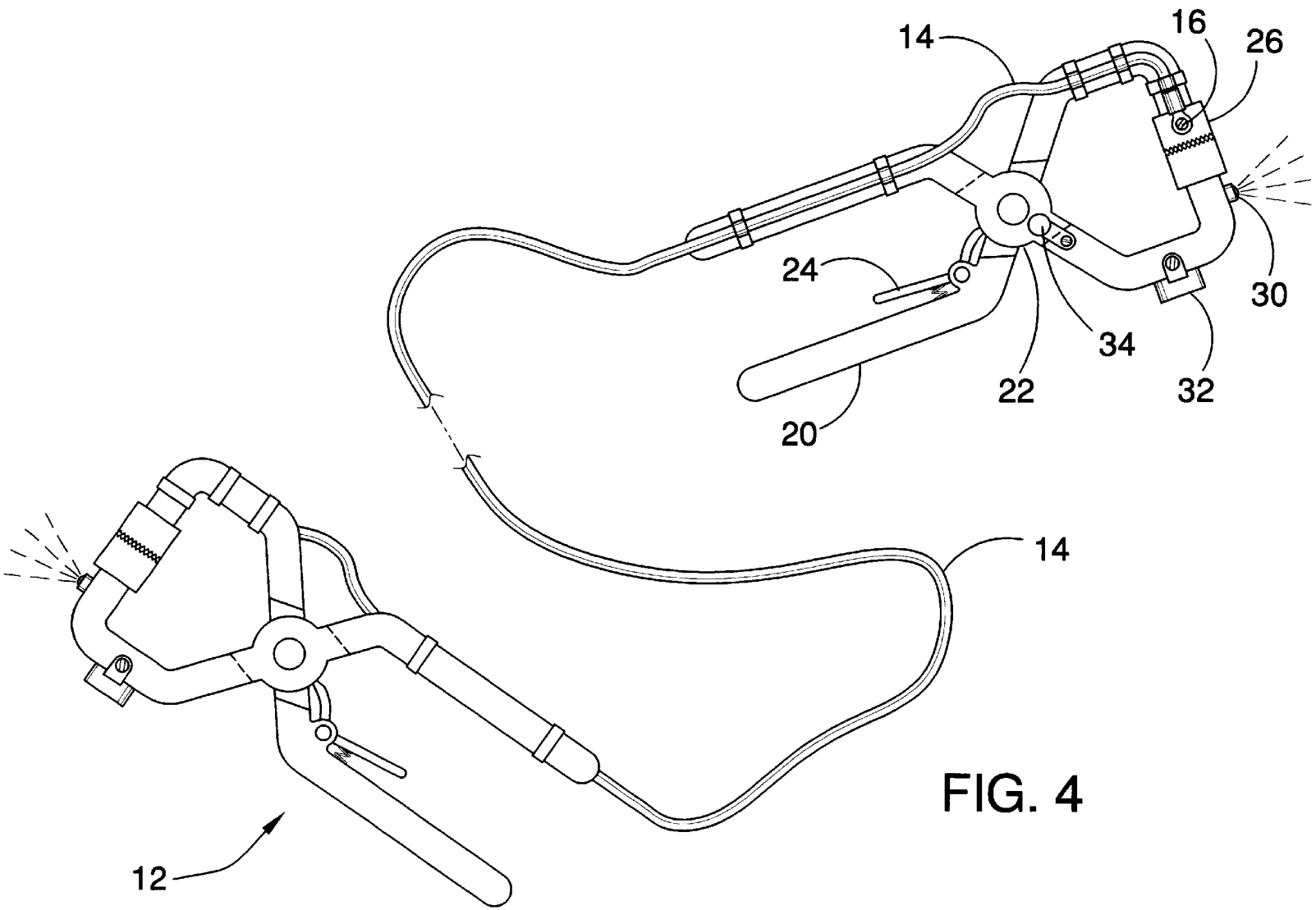
FIG. 4 is a perspective view of a preferred embodiment of a jumper cable assembly having a quick grip constructed in accordance with the principles of the present invention.

Referring now to the drawings, and particularly to FIGS. 1–6: in FIGS. 1 and 4, preferred embodiments of the jumper cable assembly of the present invention are shown and generally designated by the reference numeral 10.

In FIG. 1, a new and improved jumper cable assembly 10 of the present invention for charging batteries is illustrated and will be described. This figure shows the vise grip version of the device. More particularly, the jumper cable assembly 10 has two terminal clamps 12 and an electrical cable 14 connecting them at a terminal point 16. The electrical cable 14 is heavily insulated and flexible and is appropriate for use in charging a 12 V battery with high amperage. A preferred cable is 4 AWG cable for high-energy electrical conductivity. Two such cable and clamps are used as the jumper cable assembly 10. The second cable and clamps may be identical to the first. Alternatively, it may be different. For example, one cable may be colored red and the second one black to denote use for connecting to a positive and negate battery terminal respectively. The terminal clamp 12 has jaws 18 which are used to connect to a battery terminal or automotive chassis. The terminal clamp 12 also has a handle section 20 that is used for opening and closing the jaws 18. A pivot section 22 connects the jaws 18 to the handle 20. The handle section 20 has a release 24 that can open the jaws 18 when they are locked closed and is formed such that the handle section 20 on each clamp 12 can be closed and locked by pressing together the handle section 20 with a single hand. With this design, little hand strength is required to close the clamp 12, and opening the clamp only requires the user to open the release 24. By maintaining a firm grip, locking grip on the terminals, the chance of a spark occurring around the battery is reduced. This prevents hydrogen and other gases from the charging battery from igniting. In addition, the secure clamping ability of the clamp 12 prevents the clamp 12 from slipping off the battery terminal or vehicle chassis and interrupting current flow to the dead battery. The solid connection makes the cable assembly 10 more effective and reliable, while also ensuring maximum possible current transfer for quick jump-starting The jaws 18 have an inner surface 26 which is in electrical connection with a battery terminal or automotive chassis when in operation. This inner surface 26 may be serrated or otherwise roughened to facilitate a good electric connection. The inner surface 26 may be shaped to fit the rounded rod of a battery terminal. The jaw section 18 is designed to connect with any size battery terminal tightly. Similarly, it is able to tightly connect to a variety of shaped battery terminals and car chassis.

The jaw section 18 also comprises a light 30 which is found at the outer edge of the jaws 18 and faces outward such that it can be focused in the direction of a battery terminal as the clamp 12 is moved towards the terminal for connection. A battery 32 is located on the clamp 12 is connected to the light 30 to supply the light 30 with power. A switch 34 is attached to the clamp near the pivot section 22 and is in electrical communication with the light 30 and the battery 32 such that when the jaws 18 are open, the light 30 is on. When the jaws 18 are closed, such as when the jumper cables 10 are charging a battery or when the jumper cables 10 are stored, the light 30 is off. The light 30 with the ability to automatically turn on when the clamps 12 are open can be used for the convenience of determining where the terminals are as well as performing a safety feature in illuminating the battery terminal area so that the polarity mix-ups when attaching the clamps 12 can be prevented.

FIG. 2 is a closer view of part of the jumper cable clamp from the angle noted in FIG. 1 by the large numbers and arrows. This view shows the clamp 12 from the top and outside of the jaw section 18, the pivot section 22 and part of the handle section 20. The light 30 is shown at the front of the jaw section 18 and the battery 32, covered by a battery access plug 36, is shown on the outside jaw section 18 near the pivot section 22. The battery access plug 36 contains a notch for easy battery removal and replacement. The battery 32 can be a standard lithium ion battery that is easily found at the store. This, along with the battery access plug 36 allows for the easy removal and replacement of the battery. However, it is envisioned that the use of LEDs as the light 30 will allow for extended use of the illuminated jumper cables without having to replace the battery because of the low energy requirements of LEDs. Also shown in this view is the electric cable 14 secured to the clamp 12 at a terminal point 16.

FIG. 3 is a closer view of part of the jumper cable clamp from the angle noted in FIG. 2 by the numbers and arrows. This figure illustrates the light function and clearly depicts the light 30, the battery 32, the battery access plug 36, and the switch 34. Wires 38 are shown connecting the light 30, the battery 32 and the switch 34. The switch 34 is placed at the pivot section 22 such that when the clamp 12 is closed, the switch 34 does not allow current to flow and when the clamp 12 is open, the switch 34 allows current to flow. The light 30 may be a light emitting diode (LED), an ultra-bright LED, an incandescent bulb, or another small lighting element; it may be white, red, or any other color. All four lights 30 may be the same color or different colors. In a preferred embodiment, all four lights 30 are white ultra-bright LEDs, giving the greatest amount of illumination for LED lights. In another preferred embodiment, the two lights 30 on the negative jumper cable 10 are white LEDs and the two lights 30 on the positive jumper cable 10 are red such that the user can easily determine which clamp should be attached to which terminal or automotive chassis.

In FIG. 4, a new and improved jumper cable assembly 10 of the present invention is illustrated and will be described. This figure shows the quick grip version of the device. More particularly, the jumper cable assembly 10 has two terminal clamps 12 and an electrical cable 14 connecting them at a terminal point 16. In this illustration, the terminal point 16 for the cable 14 is located on the jaw section 18 of the clamp 12. The terminal point is in electrical communication with the inner surface of the jaws 26 which will contact a battery terminal or automotive chassis during battery charging. The electrical cable 14 is guided along one side of the jaw section 18 and handle section 20 where it is then left free until it reaches the second terminal clamp 12. The jaws 18 are used to connect to a battery terminal or automotive chassis and can be opened by exerting pressure on the handle section 20; they will open 1, 2, 3, 4 or more inches and preferably open widely enough for easy movement and attachment to the battery terminal. A pivot section 22 connects the jaws 18 to the handle 20. The handle section 20 also comprises a release lever 24 located on the side of the handle section 20 that does not contain the electrical cable 14. Flipping the release lever 24 causes the jaws 18 to open when they are locked closed.

A light 30 is found on the jaw section 18 which is found at the outer portion of the jaws and faces outward such that it is focused in the direction of a battery terminal as the clamp 12 is moved towards the terminal for connection. A battery 32 is connected to the light 30 to supply the light 30 with power. A switch 34 is attached to the clamp near the pivot section 22 and is in electrical communication with the light 30 and the battery 32.

Figure 5:
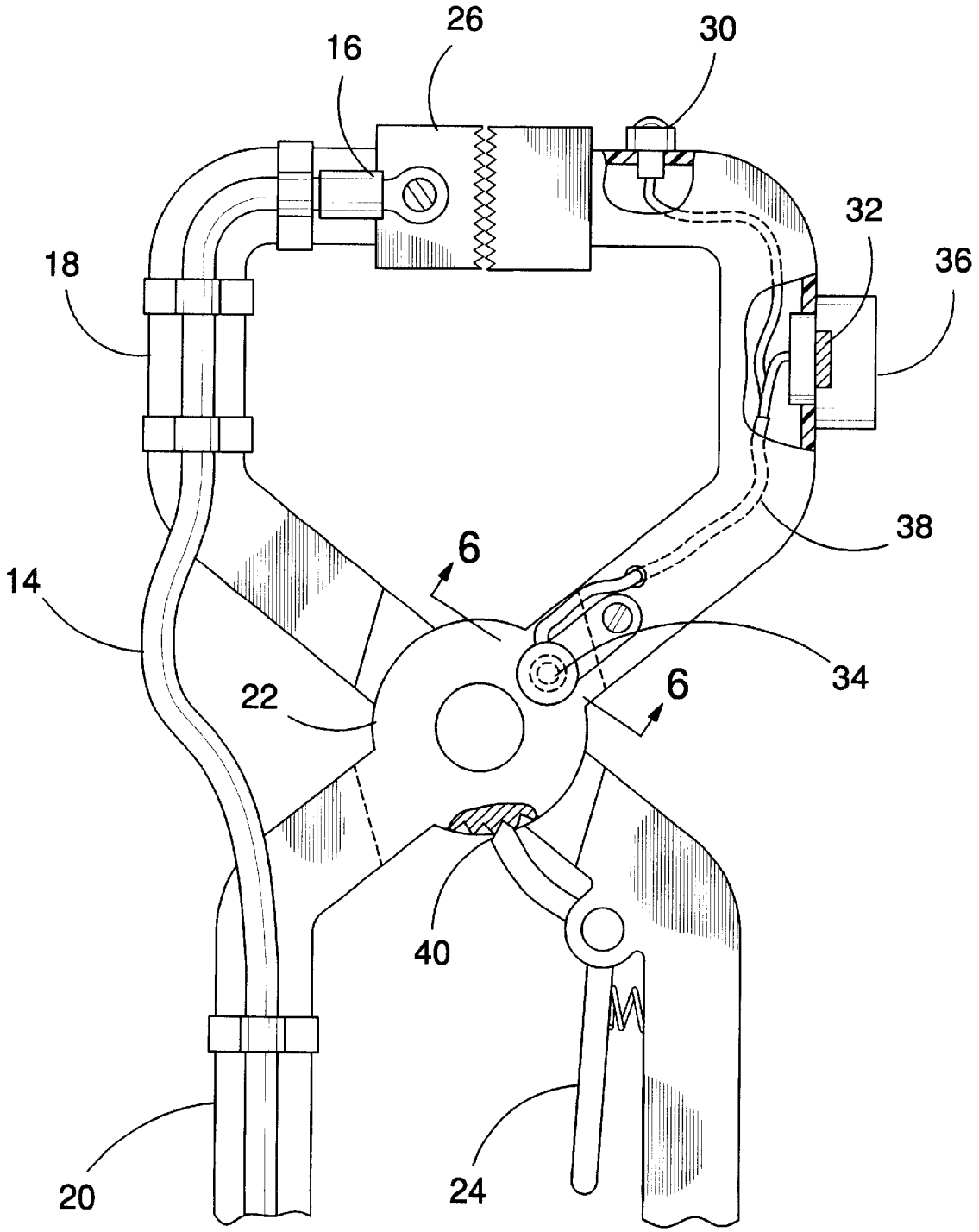
FIG. 5 is a frontal view of a quick grip clamp section of a jumper cable assembly of the present invention.

In FIG. 5, a closer view of a clamp is shown. The electrical connections of the light 30 is shown and is similar to the lighting system shown in FIGS. 1–3, where the wires 38 connect the light 30, the battery 32 and the switch 34. A battery access plug 36 covers the battery 32 for easy removal and replacement of the battery. The switch 34 is placed at the pivot section 22 such that when the clamp 12 is closed, the switch 34 does not allow current to flow and when the clamp 12 is open, the switch 34 allows current to flow. A depiction of the release lever 24 is shown along with a ratchet 40 which is used to lock the jaw section 18 and prevent it from slipping off of a battery terminal when closed.

Figure 6:
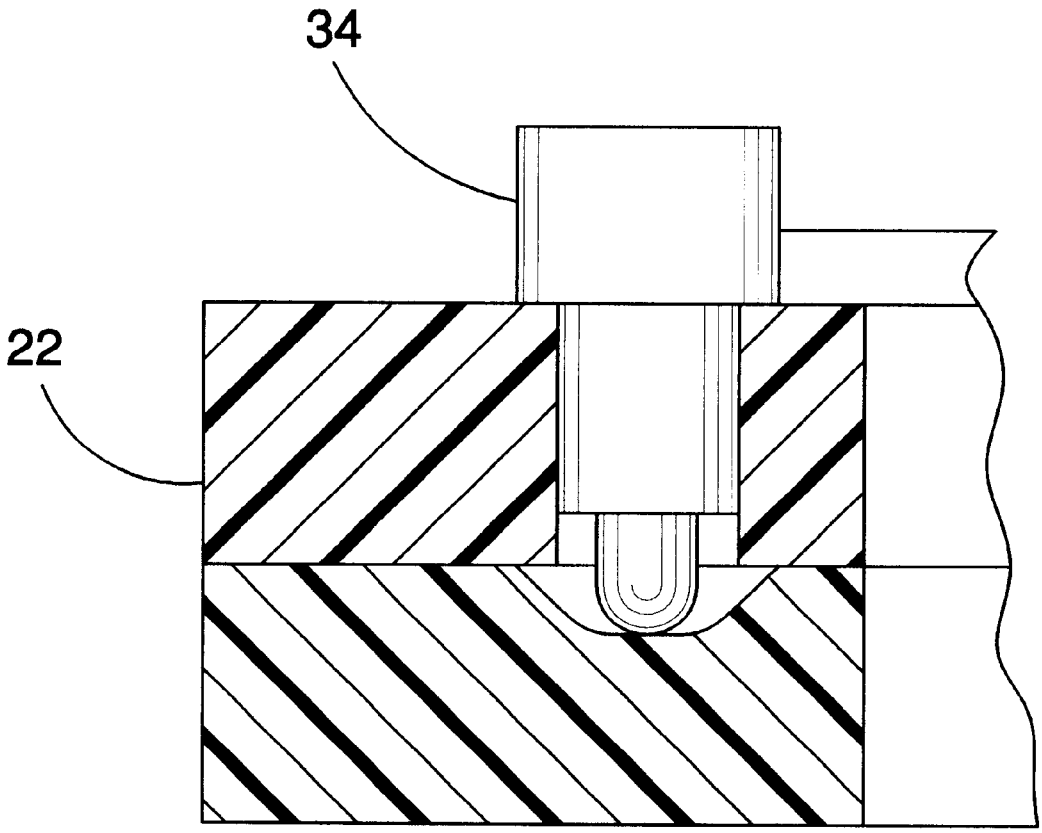
FIG. 6 is a side view near the pivotal region of a quick grip clamp section of a jumper cable assembly of the present invention.

FIG. 6 is a closer view of part of the jumper cable clamp 12 at the pivot point 22 as noted in FIG. 5 by the numbers and arrows. This figure illustrates the function of the switch and how it is affected by the movement of the clamp 12 opening and closing. In this view, as the clamp jaws are opened, the two halves of the move in opposite directions, with the upper portion moving to the right and the lower portion moving to the left. This allows the switch 34 to extend when it is adjacent to the groove in the lower section. As the clamp pivots, the switch 34 is compressed as it moves from the groove and is pushed into a smaller volume.

To operate the jumper cable assembly as described herein, the user will open the clamps 12 to illuminate the work area. The clamps 12 are opened at wide (e.g. three inches) for easy maneuvering and application to the terminals or chassis by squeezing the clamp handles 18. The four clamps 12 are applied to the battery terminals or chassis of the charged and "dead" batteries, making sure that the positive terminal of the charged battery is connected to the positive terminal of the discharged battery with one cable and the negative terminal is connected to ground with the other. This can be done by squeezing with a single hand. The jaws are locked and secured to the terminals due to the ratcheting or vise grip locking mechanism and remain on the terminal such that the clamp can not accidentally fall or vibrate loose during the jump-start procedure. The battery is than allowed to charge until it has reached an acceptable level. Then the jumper cable assembly 10 is removed from the batteries by flipping the release levers 24 located on the clamps 12. The jaws of the clamps are then closed; this automatically turns off the light.

The jumper cable assembly described herein can be used by a number of people including private motorists, truck drivers, professional mechanics, recreation boat owners, motorcyclists, and others who need to charge batteries and jump-start engines.

While a preferred embodiment of the jumper cable assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable materials may be used. For example, the clamp jaws and electrical cable may be made out of a metal or any other conductive materials and the clamp handles may be made out of a metal, plastic, or a variety of wood.

As used herein, the term approximately means within 30%.

As used herein, "a" or "an" may mean one or more. As used herein in the claim(s), when used in conjunction with the word "comprising", the words "a" or "an" may mean one or more than one.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jumper cable assembly comprising:

a positive insulated electrical cable;

a pair of positive terminal clamps attached in electrical communication at either end of said positive cable, wherein said clamps each comprise:

a handle section, a jaw section, a pivot section joining said handle section with said jaw section, a means of locking in and releasing said jaws section from a closed position and a lighting element in electrical communication with a battery and a switch wherein current flows through said lighting element when said jaw section is open and no current flows through said lighting element when said jaw section is closed;

a negative insulated electrical cable; and a pair of negative terminal clamps attached in electrical communication at both end of said negative cable, wherein said clamps each comprise:

a handle section, a jaw section, a pivot section joining said handle section with said jaw section, a means of locking and releasing said jaws section closed, and a lighting element in electrical communication with battery and a switch wherein current flows through said lighting element when said jaw section is open and no current flows through said lighting element when said jaw section is closed.

2. The jumper cable assembly of claim 1, wherein the positive and negative insulated electrical cables are 4 AWG cables.

3. The jumper cable assembly of claim 1, wherein said lighting element is an ultra-bright LED.

4. The jumper cable assembly of claim 1, wherein said lighting elements on said positive terminal clamps are a different color than said lighting elements on said negative terminal clamps.

5. The jumper cable assembly of claim 1, wherein said switch for said lighting element is at said pivot section.

6. The jumper cable assembly of claim 1, wherein said lighting element is on said jaws section and is directed away from said clamp.

7. The jumper cable assembly of claim 1, wherein said means of locking said jaws section closed is a ratcheting system.

8. The jumper cable assembly of claim 1, wherein said means of locking said jaws section closed is a vise grip system.

9. The jumper cable assembly of claim 1, further comprising a pressure release lever attached to the inner side of a handle section wherein said pressure release lever unlocks said jaws section.

10. The jumper cable assembly of claim 9, wherein the electrical cable is attached to each terminal clamp at the first handle of said handle section and said pressure release lever is attached to said terminal clamp at the second handle of said handle section.

11. The jumper cable assembly of claim 1, wherein said jaws open to at least three inches.

12. The jumper cable assembly of claim 1 wherein said battery is a replaceable lithium ion battery.

13. The jumper cable assembly of claim 1, wherein said positive and negative insulated electrical cables are long enough to reach between a charged and a discharged battery.

14. A jumper cable assembly comprising:

a positive insulated electrical cable;

a pair of positive terminal clamps attached in electrical communication at either end of said positive cable, wherein said clamps each comprise:

a handle section, a jaw section, a pivot section joining said handle section with said jaw section, a means of locking and releasing said jaws section closed, and a light emitting diode (LED) in electrical communication with a battery and a switch wherein current flows through said LED when said jaw section is open and no current flows through said LED when said jaw section is closed;

a negative insulated electrical cable; and a pair of negative terminal clamps attached in electrical communication at both end of said negative cable, wherein said clamps each comprise:

a handle section, a jaw section, a pivot section joining said handle section with said jaw section, a means of locking and releasing said jaws section closed, and a light emitting diode (LED) in electrical communication with a battery and a switch wherein current flows through said LED when said jaw section is open and no current flows through said LED when said jaw section is closed.

15. The jumper cable assembly of claim 14, wherein the positive and negative insulated electrical cables are 4 AWG cables.

16. The jumper cable assembly of claim 14, wherein said means of locking said jaws section closed is a ratcheting system.

17. The jumper cable assembly of claim 14, wherein said means of locking said jaws section closed is a vise grip system.

18. The jumper cable assembly of claim 16, further comprising a pressure release lever attached to the inner side of a handle section wherein said pressure release lever unlocks said jaws section.

19. The jumper cable assembly of claim 14, wherein said jaws open to at least three inches.

20. A terminal clamp for a jumper cable comprising:

a handle section, a jaw section, a pivot section joining said handle section with said jaw section, a ratcheting system or a vise grip system for locking said jaws section, a pressure release lever attached to the inner side of said handle section for unlocking said jaws section, and a light emitting diode (LED) in electrical communication with a lithium ion battery and a switch wherein current flows through said LED when said jaw section is open and no current flows through said LED when said jaw section is closed, wherein said terminal clamp is adapted for attachment to a 4 AWG electrical cable.

* * * * *